US007696459B2

(12) United States Patent
Harnoy

(10) Patent No.: US 7,696,459 B2
(45) Date of Patent: Apr. 13, 2010

(54) TECHNIQUES FOR ARTICULATING A NOSE MEMBER OF A GUIDABLE PROJECTILE

(75) Inventor: Amir Harnoy, Woodland Hills, CA (US)

(73) Assignee: HR Textron, Inc., Santa Clara, CA (US)

( * ) Notice: Subject to any disclaimer, the term of this patent is extended or adjusted under 35 U.S.C. 154(b) by 181 days.

(21) Appl. No.: 11/811,831

(22) Filed: Jun. 12, 2007

(65) Prior Publication Data

US 2008/0308671 A1 Dec. 18, 2008

(51) Int. Cl.
*F42B 15/01* (2006.01)
*F03D 9/00* (2006.01)
*F42B 15/00* (2006.01)

(52) U.S. Cl. ..... 244/3.1; 244/3.11; 244/3.15; 290/7; 290/43; 290/44; 102/200; 102/206; 102/207

(58) Field of Classification Search ..... 244/3.1–3.3; 89/1.11; 102/200, 206–220, 501–528; 290/7, 290/43, 44; 310/10, 40 R, 179, 195, 209
See application file for complete search history.

(56) References Cited

U.S. PATENT DOCUMENTS 3,167,275 A 1/1965 Hermann et al.
3,611,943 A * 10/1971 Popper ..... 102/208
3,747,529 A 7/1973 Plattner
3,826,193 A 7/1974 Rognmo et al.
3,920,200 A * 11/1975 Evans et al. ..... 244/3.16
3,994,228 A 11/1976 Hurlimann
4,004,519 A * 1/1977 Hopkins ..... 102/208
4,088,076 A * 5/1978 Karayannis ..... 102/209
4,142,696 A * 3/1979 Nottingham ..... 244/3.16
4,214,533 A * 7/1980 Fine et al. ..... 102/209
4,248,153 A 2/1981 Sjotun et al.
4,577,116 A 3/1986 Pinson
4,600,166 A * 7/1986 Califano et al. ..... 244/3.16
4,665,332 A 5/1987 Meir
4,898,342 A * 2/1990 Kranz et al. ..... 244/3.21
4,964,593 A * 10/1990 Kranz ..... 244/3.24
5,101,728 A * 4/1992 Frink ..... 102/209
5,115,742 A * 5/1992 Frazer ..... 102/208
5,271,328 A * 12/1993 Boulais et al. ..... 102/207
5,452,864 A * 9/1995 Alford et al. ..... 244/3.23

(Continued)

FOREIGN PATENT DOCUMENTS

DE 102005043474 A1 3/2007

(Continued)

*Primary Examiner*—Bernarr E Gregory
(74) *Attorney, Agent, or Firm*—BainwoodHuang

(57) ABSTRACT

A guidable projectile has a nose member, a projectile body, and a nose member articulation assembly which couples the nose member to the projectile body. The nose member articulation assembly includes a stator attached to the nose member, a rotor attached to the projectile body, and rotational support hardware interconnecting the stator to the rotor. The stator defines a central axis. The rotational support hardware is constructed and arranged to guide rotation of the rotor around the central axis defined by the stator. Such a guidable projectile enables circuitry such as the driver of the stator and the power source to reside at fixed locations relative to the stator thus alleviating the need for slip rings which would otherwise present potential points of failure.

20 Claims, 5 Drawing Sheets

U.S. PATENT DOCUMENTS

| | | | | |
|---|---|---|---|---|
| 6,364,248 | B1 | 4/2002 | Spate et al. | |
| 6,455,975 | B1 * | 9/2002 | Raad et al. | 310/209 |
| 6,845,714 | B1 * | 1/2005 | Smith et al. | 102/208 |
| 6,952,058 | B2 * | 10/2005 | McCoin | 290/44 |
| 7,095,193 | B2 | 8/2006 | Kellogg et al. | |
| 7,109,679 | B2 | 9/2006 | Edson et al. | |
| 7,116,100 | B1 | 10/2006 | Mock et al. | |
| 7,431,237 | B1 * | 10/2008 | Mock et al. | 244/3.24 |
| 2006/0065775 | A1 | 3/2006 | Smith et al. | |
| 2008/0142591 | A1 | 6/2008 | Jenkins et al. | |
| 2008/0302906 | A1 | 12/2008 | Bar et al. | |

FOREIGN PATENT DOCUMENTS

| | | | |
|---|---|---|---|
| EP | 0675335 | A2 | 10/1995 |
| EP | 1635135 | A1 | 3/2006 |
| EP | 1930686 | A1 | 6/2008 |
| GB | 1605392 | A | 4/1995 |
| WO | 8203453 | A | 10/1982 |
| WO | 2007030687 | A2 | 3/2007 |
| WO | 2008108869 | A2 | 9/2008 |

* cited by examiner

TECHNIQUES FOR ARTICULATING A NOSE MEMBER OF A GUIDABLE PROJECTILE

BACKGROUND

A typical conventional guided projectile includes a nose cone and a main casing (e.g., an artillery shell casing). The nose cone is capable of moving relative to the main casing and is thus capable of changing the direction of the projectile's trajectory while the projectile is in flight.

To effectuate movement of the nose cone relative to the main casing, the conventional guided projectile further includes a nose cone actuator having an actuator mount and a movable (or actuated) part which moves relative to the actuator mount. The actuator mount of the actuator connects to the main casing and the movable part of the actuator connects to the nose cone to enable pointing or articulating the nose cone relative to the main casing.

In some conventional guided projectile designs, the main casing and the nose cone are required rotate relative to each other. For such designs, the entire nose cone actuator (i.e., the actuator mount and the movable part) rotates relative to the main casing so that the nose cone actuator can continue to point the nose cone in a particular targeted direction. That is, while the main casing rotates around both the actuator mount and the movable part of the nose cone actuator during flight, the actuator extends or retracts the movable part to properly articulate the nose cone at a particular angle relative to a center axis of the main casing thus controlling the direction of the guided projectile.

SUMMARY

Unfortunately, there are deficiencies to certain conventional guided artillery shell designs due to demands placed on various components of these designs. In particular, if the control circuitry and the power source for the nose cone actuator reside at fixed locations within the main casing, specialized connecting devices are required to transmit electrical power and electrical control signals from the control circuitry and the power source within the main casing to the nose cone actuator while the main casing rotates relative to the nose cone actuator.

An example of such a specialized connecting device is a slip ring, i.e., a rotary electrical joint. Unfortunately, slip rings provide potential points of failure particularly in view of various extreme environmental conditions that may exist within the guided projectile (e.g., high G-forces, high temperatures, etc.). That is, it is extremely difficult for slip rings to survive the high acceleration of the guided projectile during launch, and then to withstand extremely high operating temperatures while the guided projectile is in flight. Without reliable performance, the guided projectile may inadvertently damage or destroy an unintended target. Furthermore, slip rings are costly and their use in a weapon system may impact the affordability of a weapon system's controller.

In contrast to the above-described conventional guided projectile designs which place the control circuitry and the power source for a nose cone actuator at fixed locations within the main casing, improved techniques involve utilization of a stator (of a brushless electric motor) which attaches to a nose member (e.g., a nose cone of a guidable projectile) and a rotor (of a brushless electric motor) which attaches to a projectile body (e.g., a main casing of the guidable projectile). Accordingly, the stator and the rotor form a motor/generator which is capable of (i) controlling rotation of the projectile body relative to the nose member as well as (ii) generating power. Moreover, electrical control of the stator and other electrical or electromechanical components (e.g., a nose cone actuator) are capable of residing at fixed locations relative to the stator (e.g., on the stator spindle) thus alleviating any need to convey electrical power and electrical control signals from the projectile body to the stator or to the nose member through slip rings.

One embodiment is directed to a guidable projectile having a nose member, a projectile body, and a nose member articulation assembly which couples the nose member to the projectile body. The nose member articulation assembly includes a stator attached to the nose member, a rotor attached to the projectile body, and rotational support hardware interconnecting the stator to the rotor. The stator defines a central axis. The rotational support hardware is constructed and arranged to guide rotation of the rotor around the central axis defined by the stator. Such a guidable projectile enables circuitry such as the driver of the stator and the power source to reside at fixed locations relative to the stator thus alleviating the need for slip rings which would otherwise present potential points of failure.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Improved nose articulation techniques involve utilization of (i) a stator which attaches to a nose member (e.g., a nose cone of a guidable projectile) and (ii) a rotor which attaches to a projectile body (e.g., a main casing of the guidable projectile). Accordingly, the stator and the rotor form a motor/generator which is capable of (i) controlling rotation of the projectile body relative to the nose member as well as (ii) generating electrical power. Moreover, electrical control of the stator and other electrical or electromechanical components (e.g., a nose cone actuator) are capable of residing at fixed locations relative to the stator (e.g., on the stator spindle) thus alleviating any need to convey electrical power and electrical control signals from the projectile body to the stator or to the nose member through slip rings.

Figure 1:
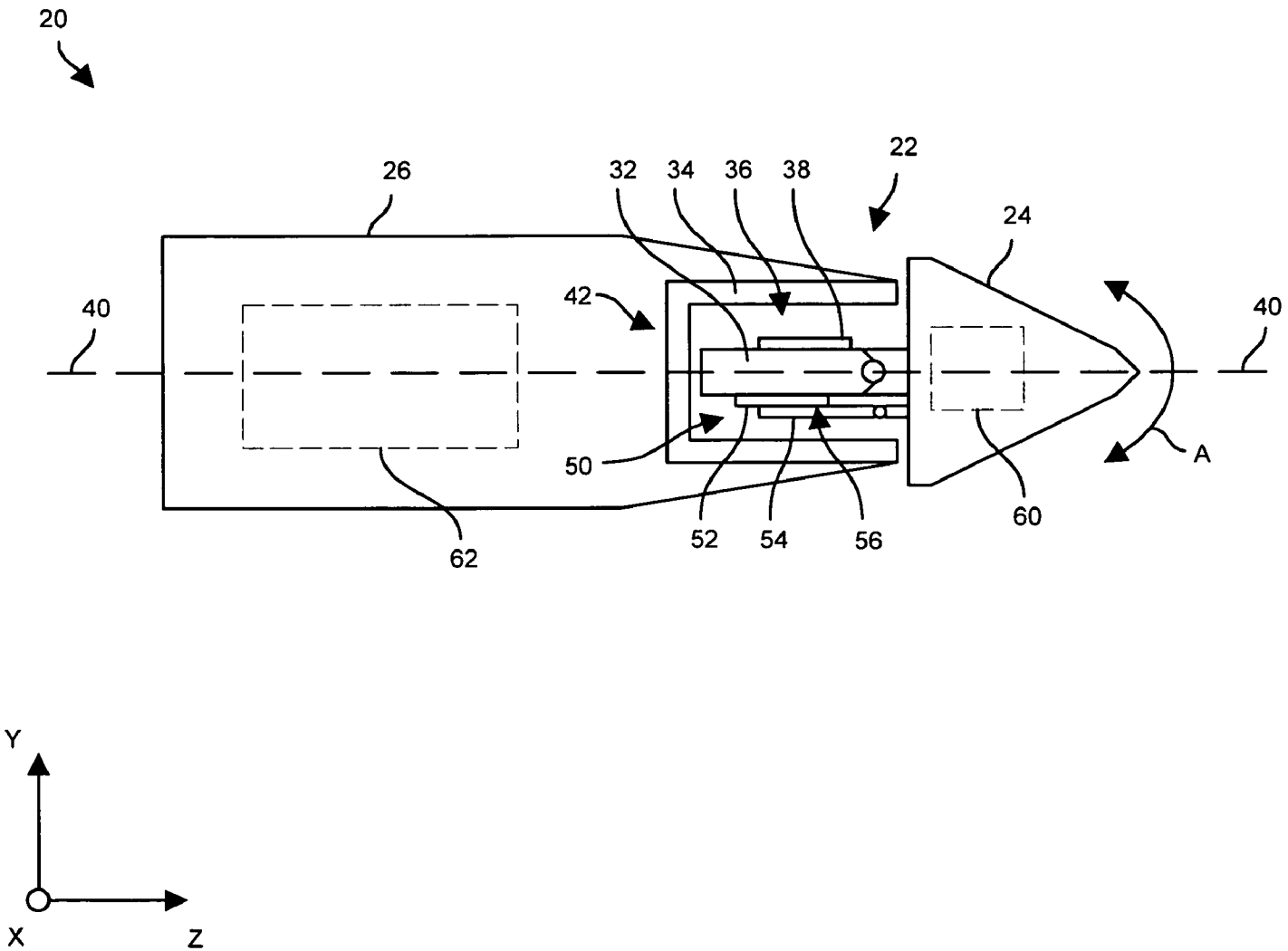
FIG. 1 is a general view of a guidable projectile having a nose member articulation assembly which includes a stator which attaches to a nose member and a rotor which attaches to a projectile body.

FIG. 1 is a general view of a guidable projectile 20 having an enhanced nose member articulation assembly 22. The guidable projectile 20 further includes a nose member 24 and a projectile (or munition) body 26. The nose member articulation assembly 22 operatively interconnects the nose member 24 and the projectile body 26 together.

As shown in FIG. 1, the nose member articulation assembly 22 includes a stator 32 (e.g., a motor winding assembly over a magnetic core), a rotor 34 (e.g., a rotatable member with magnet poles and magnetic back iron), rotational support hardware 36 (shown generally by the arrow 36 in FIG. 1), and control circuitry 38. The stator 32 pivotally attaches to the nose member 24. The rotor 34 rigidly attaches to the projectile body 26. The rotational support hardware 36 (shown in further detail in later figures) interconnects the stator 32 to the rotor 34 in a rotatable manner which enables the rotor 34 to rotate relative to the stator 34 around the central axis 40. The control circuitry 38 mounts to a fixed location on the stator 32.

As will be explained in further detail shortly, the rotational support hardware 36 includes bearings and specialized components and geometries which cooperatively unload extreme G-force stresses (e.g., high-G shock pulses encountered during a cannon launch condition) from the bearings. These specialized components and geometries nevertheless provide collapsible energy absorbing interfaces under lower G-force stresses.

As further shown in FIG. 1, the stator 32 is substantially elongated in shape and defines a central axis 40 along which the nose member 24 and the projectile body 26 preferably extend. Additionally, the stator 32 and the rotor 34 form a motor/generator 42 which is constructed and arranged to control rotation of the rotor 34 relative to the stator 32 around the central axis 40 based on electrical signals from the control circuitry 38 (e.g., via alternating current through the stator 32). The motor/generator 42 further generates power to reduce battery requirements of the nose member articulation assembly 22 (e.g., to reduce the number and/or size of power cells mounted to a fixed location on the stator 32).

The nose member articulation assembly 22 further includes a nose member actuator 50 having a base 52, an arm 54 and a motor 56 (shown generally by the arrow 56 in FIG. 1). The base 52 of the nose member actuator 50 mounts to a fixed location on the stator 32. The arm 54 of the nose member actuator 50 pivotally mounts to the nose member 24. The motor 56 of the nose member actuator 50 controls movement of the arm 54 relative to the base 52. In some arrangements, the nose member actuator 50 is formed by a drive screw actuator and a crank arm. It should be understood that the position the arm 54 and the base 52 relative to each other controls the angular displacement (X) of the nose member 24 relative to the projectile body 26. If alignment with the central axis 40 is considered zero degrees, the range of potential displacement (A) is preferably up to 12 degrees. Other ranges of displacement are suitable as well such as +/−10 degrees, and so on.

During operation, a launch system (e.g., a cannon) is capable of firing the guidable projectile 20 in the positive Z-direction. In this situation, the entire guidable projectile 20 spins or rifles in a particular rotational direction around the Z-axis (e.g., clockwise when viewed facing the nose member 24 of the guidable projectile 20). The control circuitry 38 is then capable of operating the motor/generator 42 in the opposite direction to that of the guidable projectile 20 (e.g., in the counterclockwise direction when viewed facing the nose member 24 of the guidable projectile 20) to slow (i.e., "de-spin") and eventually stop the stator 32 and the nose member 24 from rotation relative to the earth. In particular, an inertial guidance system is capable of providing input to the control circuitry 38 to direct the motor 42 to provide a proper amount of rotation in the opposite direction so that the stator 32 and the nose member 24 are no longer substantially rotating relative to points on the ground.

Once the motor/generator 42 has de-spun the stator 32 and the nose member 24 relative to the ground, the stator 32 and the nose member 24 are essentially in a geostatic orientation in terms of rotation. In this situation, the inertial guidance system is capable of directing the control circuitry 38 to modify the angular displacement (or tilt) of the nose member 24 and is thus capable of controlling the trajectory of the guidable projectile 20 while the guidable projectile 20 is in flight.

For example, suppose that the guidable projectile 20 is in substantially horizontal flight and that the stator 32 is in the orientation shown in FIG. 1. That is, the Z-axis points in the direction of flight and the Y-axis points away from the ground. Here, a linear displacement of the arm 54 in the negative Z-direction results in tilting of the nose member 24 in a downward direction thus steering the guidable projectile 20 in the negative Y-direction toward the ground. Similarly, linear displacement of the arm 54 in the positive Z-direction results in pointing of the nose member 24 in an upward direction thus possibly providing a lifting vector to the guidable projectile 20 in the positive Y-direction which enables the guidable projectile 20 to extend its ground distance. Other directional changes are available as well by changing the rotational speed of the generator/motor 42 to orient the stator 32 at a different angle relative to the ground and then operating the nose member actuator 50 (i.e., azimuth control).

It should be understood that the above-described guidable projectile 20 is suitable for a variety of applications including guided rockets, guided missiles, guided torpedoes, and similar guidable objects. In some arrangements, the nose member 24 defines a space 60 which is capable of supporting a payload (e.g., an inertial guidance system, sensors, other electronics, an explosive charge, etc.). Similarly, in some arrangements, the projectile body 26 defines a space 62 which is capable of supporting another payload (e.g., a propulsion system, an explosive charge, etc.).

It should be further understood that containment of the motor stator 32, control circuitry 38 and other control electronics (e.g., batteries, an inertial guidance system in the space 60 defined by the nose member 24, etc.) is capable of occurring exclusively on the stator 32 and/or the nose member 24. Accordingly, there is no need to convey electrical signals from the rotor 34 or the projectile body 26. As a result, no slip rings are required to power or control the motor/generator 42. Further details will now be provided with reference to FIG. 1.

Figure 2:
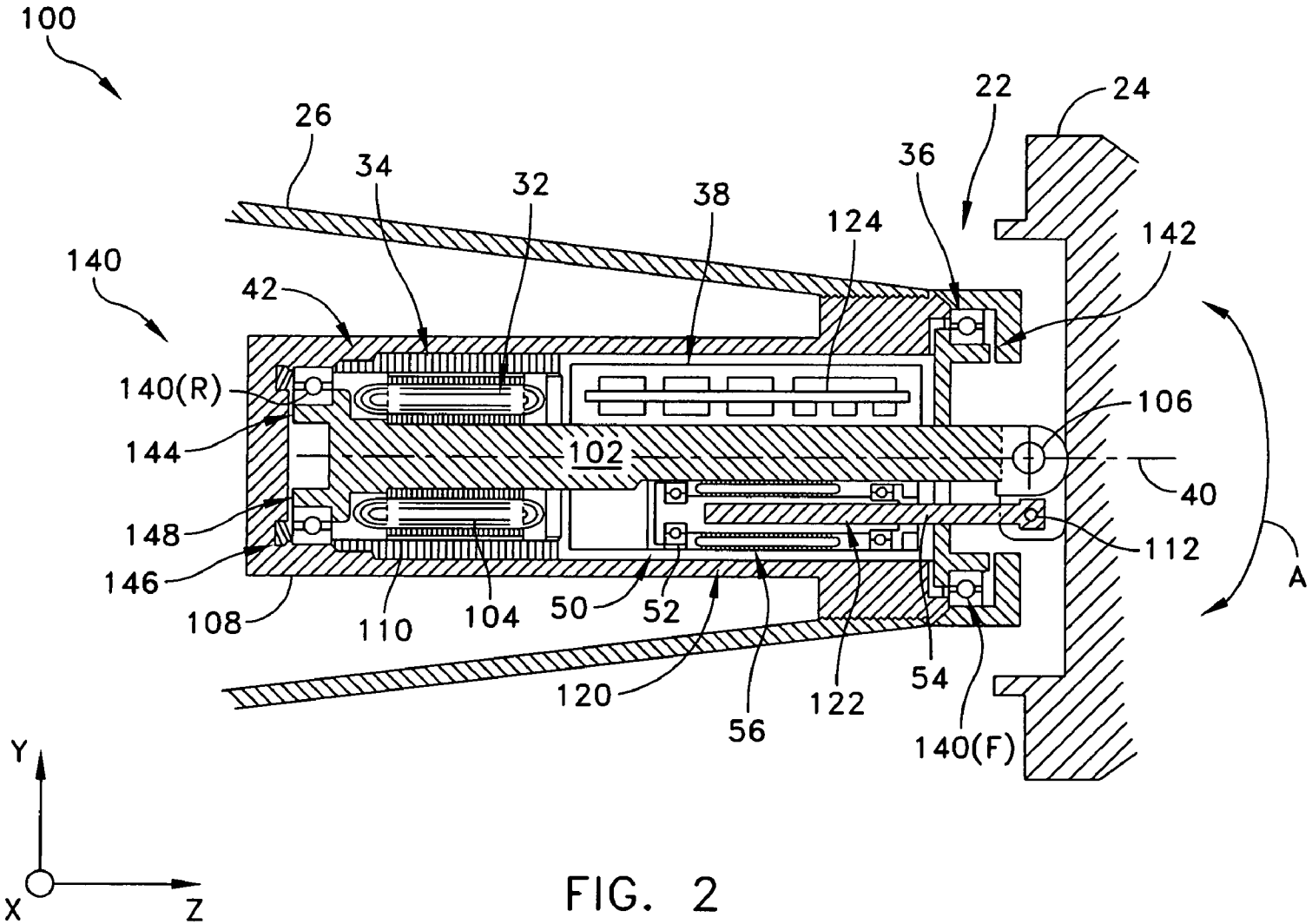
FIG. 2 is a detailed cross-sectional view of the guidable projectile of FIG. 1.

FIG. 2 is a cross-sectional view of a portion 100 of an embodiment of the guidable projectile 20. As shown, the stator 32 of the motor/generator 42 includes a stator shaft (or spindle) 102 and a set of motor windings 104. The stator shaft 102 extends along the central axis 40, and rigidly supports the motor windings 104.

Additionally, the stator shaft 102 is rotationally static with respect to the nose member 24. That is, the stator shaft 102 is capable of rotating relative to the rotor 34 about the central axis 40 in unison with the nose member 24. Furthermore, the nose member 24 is capable of pivoting relative to the stator shaft 102 about a hinge 106 which extends along the X-axis in FIG. 2.

The rotor 34 of the motor/generator 42 includes a rotor housing 108 and a set of magnets 110. The rotor housing 108 rigidly supports the magnets 110. The rotor housing material is composed of a soft magnetic material (i.e., material with low magnetic permeability), such as iron or steel to close the electromagnetic flux path between the opposite poles of the magnet. Alternatively, the magnets are supported within the inside diameter of a ring of soft magnetic material which is secured to the rotor housing. In some arrangements, the material of the rotor housing 108 has soft magnetic properties so that the rotor housing 108 acts as the back iron for the magnets 110. Alternatively, rare earth magnets, ring magnets, Samarium-Cobalt magnets, and so on are capable of being used.

It should be understood that there is a motor/generator relationship between the windings 104 of the stator 32 and the magnets 110 of the rotor 34. Along these lines, during operation, the control circuitry 38 of the motor/generator 42 is constructed and arranged to control electric current through the windings 104 of the stator 32 (e.g., commutation) and thus control rotation of the rotor 34 around the stator 32. Such motorized operation enables the stator 32 and the nose member 24 to remain stationary from a rotational standpoint relative to the ground during flight, while the rotor 34 and the projectile body continue to rotate around the central axis 40 (e.g., at several thousands of rotations per minute).

Although power cells have been omitted from FIG. 2 for simplicity, it should be understood that the guidable projectile 20 preferably includes a set of power cells, and that rotation of the motor/generator 42 generates power that decreases the need for a large number of cells and/or for large power cell capacity. That is, due to rotation of the rotor 34 relative to the stator 32 of the motor/generator 42, the windings 104 are capable of providing a charge which recharges or sustains the power cells. Preferably, the power cells reside on the stator shaft 102 at a fixed location for convenient electrical connection to the control circuitry 38.

As further shown in FIG. 2, the base 52 of the nose member actuator 50 mounts to a fixed location on the stator shaft 102 and is thus rotationally static with respect to the stator shaft 102 and the nose member 24. The arm 54 of the nose member actuator 50 is pivotally attached to an offset location on the nose member 24. In particular, the arm 54 is capable of tilting the nose member 24 about a hinge 112, which extends along the X-axis in FIG. 2 and which is offset (e.g., off center) from the stator shaft hinge 106. Accordingly, the arm 54 is well-positioned to tilt the nose member 24 around the stator shaft hinge 106 to an angular displacement (A) relative to the stator 32.

It should be understood that the nose member actuator 50 is capable of being implemented as a drive screw actuator 120 and a crank arm 122. In this situation, the nose member 24 preferably can rotate up to 12 degrees from the central axis 40 in any direction due to operation of the drive screw actuator 120 (for tilting about the hinge 106) and further due to operation of the motor/generator 42 (for orientation of the stator shaft 102 around the central axis 40).

In some arrangements, the control circuitry 38 includes a two-channel drive circuit 124 having a first channel to drive the motor/generator 42, and a second channel to drive the nose member actuator 50. In these arrangements, the control circuitry 38 preferably receives signals from position sensors (e.g., Hall effect sensors) for feedback control. Since the control circuitry 38 resides at a fixed mounting location on the stator shaft 102 and electrically connects to both the motor/generator 42 and the nose member actuator 50 which are also at fixed mounting locations on the stator shaft 102, there is no need for any slip rings to convey electrical signals there between.

As further shown in FIG. 2, the rotational support hardware 36 of the nose member articulation assembly 22 includes a set of front bearings 140(F) and a set of rear bearings 140(R) (collectively, bearings 140). The front bearings 140(F) are disposed adjacent a front end 142 of the stator shaft 102. The rear bearings 140(R) are disposed adjacent a rear end 144 of the stator shaft 102. The bearings 140 are arranged to facilitate rotation of the rotor housing 108 relative to the stator shaft 102 around the central axis 40.

The rotation support hardware 36 further includes a set of energy absorbing interfaces 146 (e.g., Belleville springs, tolerance rings, etc.) which provide dampening and cushioning between the stator shaft 102 and the rotor housing 108. As will be discussed in further detail shortly, the stator shaft 102 defines a set of unloading surfaces 148. These unloading surfaces 148 are arranged to make contact with the rotor housing 108 to prevent overloading of the bearings 140 and the energy absorbing springs 146 when the guidable projectile 20 undergoes extreme acceleration (e.g., acceleration above a predefined threshold) in various directions such as in the positive Z-direction when the guidable projectile 20 is launched from a cannon. Further details will now be provided with reference to FIG. 3.

Figure 3:
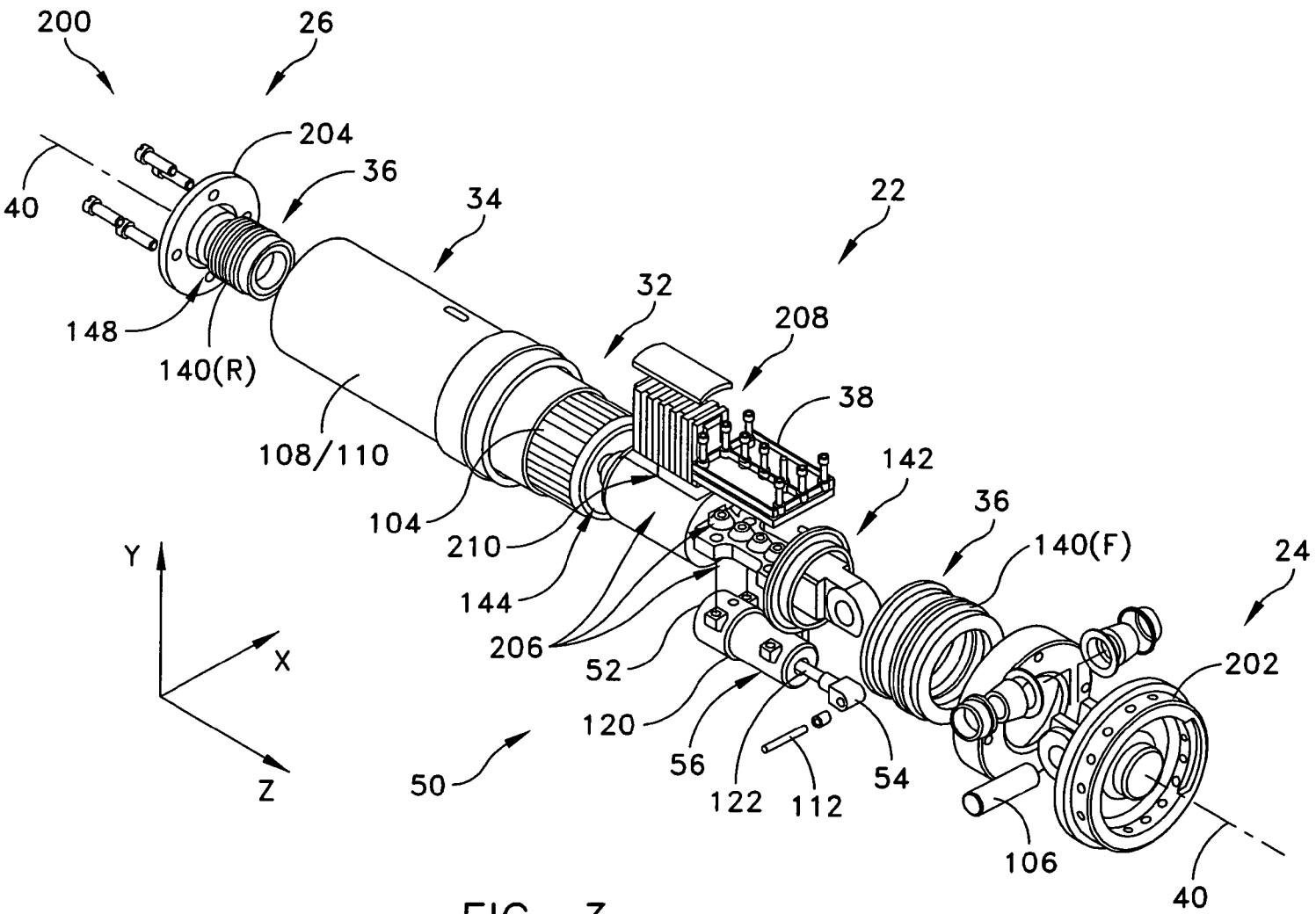
FIG. 3 is an exploded perspective view of the guidable projectile of FIG. 1.

FIG. 3 is a detailed exploded perspective view of a portion 200 of an embodiment of the guidable projectile 20. As shown, the stator shaft 102 is constructed and arranged to pivotally link with a portion 202 of the nose member 24. Furthermore, the rotor housing 108 is constructed and arranged to rigidly fasten to a portion 204 of the projectile body 26.

As further shown in FIG. 3, the stator shaft 102 defines multiple mounting locations 206 on which certain components are capable of rigidly mounting. In particular, the control circuitry 38, the nose member actuator 50, and power cells 208 rigidly mount to the stator shaft 102 at those mounting locations 206. Accordingly, the stator shaft 102 essentially acts as a platform for supporting a variety of operating components.

By way of example only, the power cells 208, which provides power to operate the motor/generator 42 and the nose member actuator 50, is shown as being contained within a hollow but enclosed cavity 210 defined by the stator shaft 102. Since the power cells 208 in combination with the motor/generator 42 are constructed and arranged to provide ample power to control rotation of the motor/generator 42 and operation of the nose member actuator 50 during flight of the guidable projectile 20, there no need for slip rings to convey electrical signals. Further details will now be provided with reference to FIGS. 4 and 5.

Figure 4:
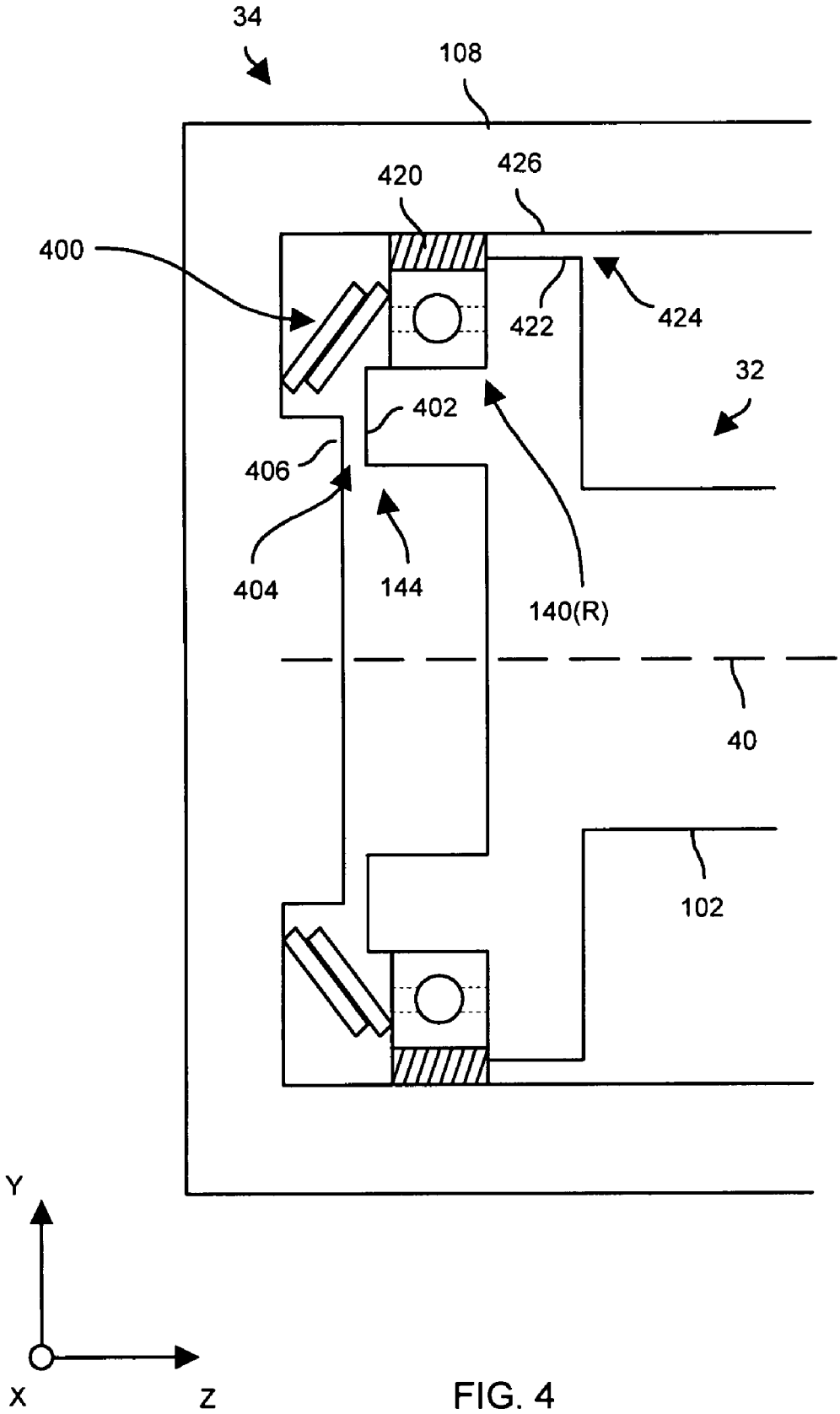
FIG. 4 is a detailed cross-sectional view of a particular portion of the guidable projectile of FIG. 1.
Figure 5:
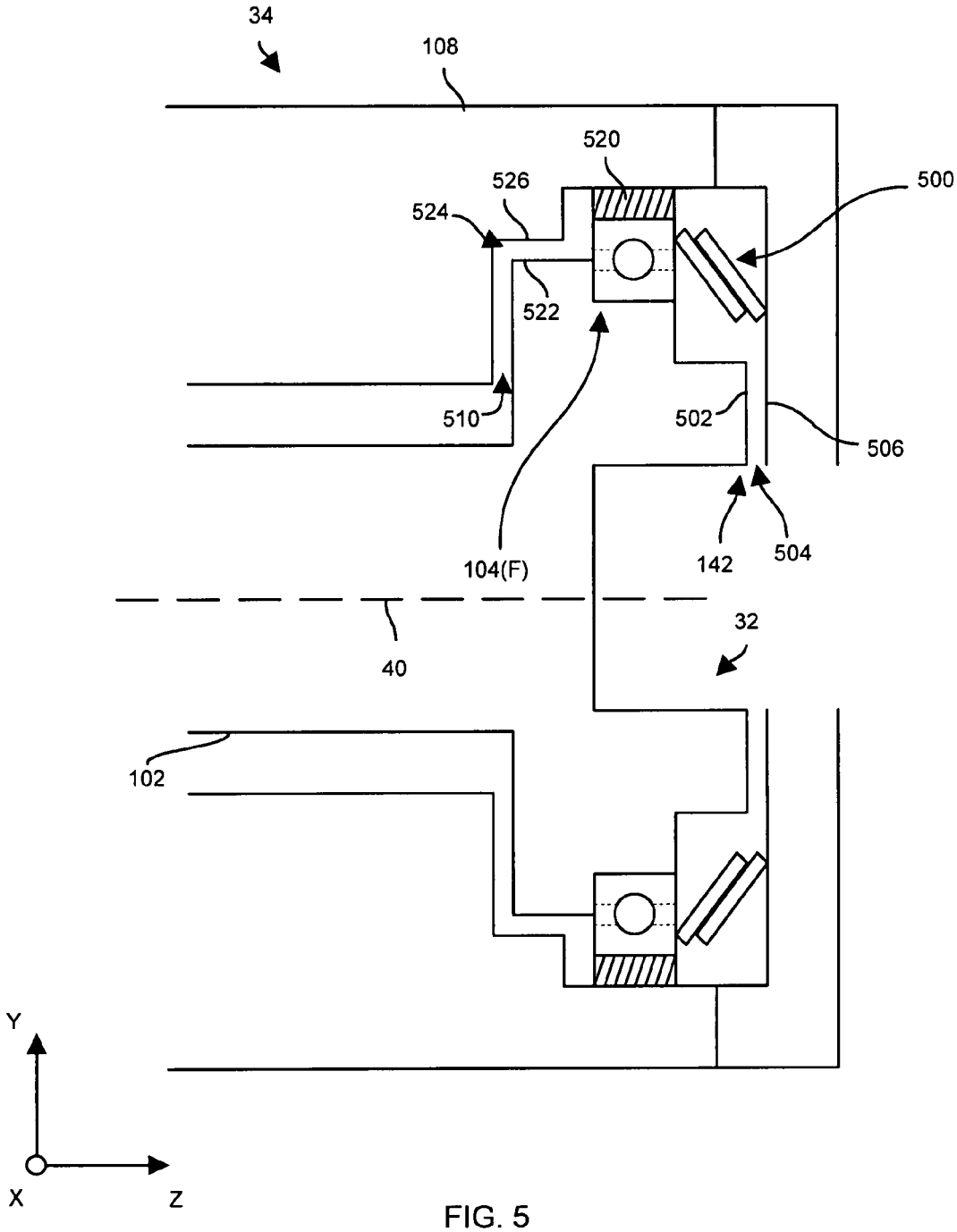
FIG. 5 is a detailed cross-sectional view of another particular portion of the guidable projectile of FIG. 1.

FIGS. 4 and 5 illustrate certain unloading features of the guidable projectile 20. FIG. 4 shows a cross-sectional view of a portion of the guidable projectile 20 at the rear end 144 of the stator shaft 102. FIG. 5 shows a cross-sectional view of a portion of the guidable projectile 20 at the front end 142 of the stator shaft 102. As shown in FIGS. 4 and 5, the rotor housing 108 rotates about the stator shaft 102 (i.e., around the central axis 40) thus enabling the stator shaft 102, the nose member 24 and various mounted components, to remain rotationally static relative to the ground, while the rotor housing 108 rifles during flight of the guidable projectile 20. It should be understood that the windings 104 of the stator 32 and the magnets 110 are purposefully omitted from FIGS. 4 and 5 to better illustrate other features of the guidable projectile 20.

As shown in FIG. 4, the rotational support hardware 36 includes a set of axial displacement loading springs 400 which are disposed between the stator shaft 102 and the rotor housing 108 (also see the energy absorbing interfaces 146 in FIG. 2). The axial displacement loading springs 400 apply a force onto the rear bearings 140(R) and the stator shaft 102 in the positive Z-direction. In some arrangements, the axial displacement loading springs 400 are Belleville springs.

As further shown in FIG. 4, the end 144 of the stator shaft 102 defines an unloading surface 402 (also see the unloading surfaces 148 in FIG. 2). An axial gap 404 exists between the unloading surface 402 and a corresponding surface 406 defined by the rotor housing 108.

Similarly, as shown in FIG. 5, the rotational support hardware 36 includes a set of axial displacement loading springs 500 which are disposed between the stator shaft 102 and the rotor housing 108. The axial displacement loading springs 500 apply a force onto the front bearings 140(F) and the stator shaft 102 in the negative Z-direction. In some arrangements, the axial displacement loading springs 500 are Belleville springs.

As further shown in FIG. 5, the end 142 of the stator shaft 102 defines an unloading surface 502. An axial gap 504 exists between the unloading surface 502 and a corresponding surface 506 defined by the rotor housing 108.

It should be understood that balancing between the axial displacement loading springs 400, 500 maintains both the axial gap 404 (FIG. 4) and the axial gap 504 (FIG. 5) during conditions of no or low acceleration. That is, the axial displacement loading springs 400, 500 effectively suspend the stator shaft 102 (or at least a portion of the stator shaft 102) within the rotor housing 108 as long as the guidable projectile undergoes acceleration which is less than a predetermined threshold (prior to launch, after launch, etc.). During this time, the axial loading springs 400, 500 operate as collapsible energy absorbing interfaces 146 (FIG. 2) between the stator shaft 102 and the rotor housing 108.

In contrast, when the guidable projectile 20 undergoes extreme high G-force acceleration in the positive Z-direction, the unloading surface 402 defined by the stator shaft 102 contacts the corresponding surface 406 defined by the rotor housing 108. Such a situation may exist during launching of the guidable projectile 20 from a cannon. During such a situation, the axial displacement loading springs 400 deform to allow direct contact between the stator shaft 102 and the rotor housing 108. As a result, the bearings 104(R) are protected against overloading and damage.

It should be understood that additional axial gaps, which are similar to the axial gap 404, may be distributed between the stator shaft 102 and the rotor housing 108. Such distributed placement of these additional axial gaps spreads out the contact surface area between the stator shaft 102 and the rotor housing 108 to reduce stresses at any particular point. By way of example, FIG. 5 shows another axial gap 510 which operates to protect the bearing rolling elements and contact raceways.

It should be further understood that, when the guidable projectile 20 undergoes extreme high G-force acceleration in the negative Z-direction, the unloading surface 502 defined by the stator shaft 102 contacts the corresponding surface 506 defined by the rotor housing 108. Here, the axial displacement loading springs 500 again deform to allow direct contact between the stator shaft 102 and the rotor housing 108. Accordingly, the bearings 104(F) are protected against overloading and damage.

Additionally, and as shown in FIG. 4, the rotational support hardware 36 further includes a set of radial displacement loading springs 420 which are disposed between the stator shaft 102 and the rotor housing 108. The radial displacement loading springs 420 apply a radial force onto the stator shaft 102 from the rotor housing 108 toward the central axis 40. In some arrangements, the set of axial displacement loading springs 420 is a set of tolerance rings or corrugated rings.

As further shown in FIG. 4, a suitable position for the set of radial displacement loading springs 420 is between the rear bearings 140(R) and the rotor housing 108. An alternative position for the set of radial displacement loading springs 420 is between the rear bearings 140(R) and the stator shaft 102.

As further shown in FIG. 4, the end 144 of the stator shaft 102 further defines an unloading surface 422. A radial gap 424 exists between the unloading surface 422 and a corresponding surface 426 defined by the rotor housing 108.

Similarly, and as shown in FIG. 5, the rotational support hardware 36 further includes a set of radial displacement loading springs 520 which are disposed between the stator shaft 102 and the rotor housing 108. The radial displacement loading springs 520 apply a radial force onto the stator shaft 102 from the rotor housing 108 toward the central axis 40. In some arrangements, the set of axial displacement loading springs 520 is a set of tolerance rings or corrugated rings.

As further shown in FIG. 5, a suitable position for the set of radial displacement loading springs 520 is between the front bearings 140(F) and the rotor housing 108. An alternative position for the set of radial displacement loading springs 520 is between the front bearings 140(F) and the stator shaft 102.

As further shown in FIG. 5, the end 142 of the stator shaft 102 further defines an unloading surface 522. A radial gap 524 exists between the unloading surface 522 and a corresponding surface 526 defined by the rotor housing 108.

It should be understood that the radial displacement loading springs 420, 520 maintain the radial gap 424 (FIG. 4) and the radial gap 524 (FIG. 5) during situations of no or little radial displacement. That is, during this time, the radial displacement loading springs 420, 520 operate as collapsible energy absorbing interfaces 146 between the stator shaft 102 and the rotor housing 108.

In contrast, during situations of substantial radial acceleration which causes significant radial displacement, one or more of the unloading surfaces 422, 522 defined by the stator shaft 102 contact the corresponding one or more surfaces 426, 526 defined by the rotor housing 108. That is, the radial displacement loading springs 420, 520 deform to allow direct contact between the stator shaft 102 and the rotor housing 108. As a result, the bearings 104(R), 104(F) are protected against damage. Such operation prevents overloading of the bearings 104(R), 104(F) when radial acceleration exceeds a predetermined threshold.

Based on the above, it should be understood that an example set of predefined thresholds is that set of thresholds which enables the various load bearing elements (e.g., the bearings 140) to survive the extreme loading encountered during a cannon launch of a guided missile. Such an extreme loading condition may last only for a split second but provide many thousands of pounds of force. For example, in the context of 20,000 to 30,000 G's on a four pound component, there could otherwise be 80,000 pounds of force on the load bearing elements without protection. To prevent such force from destroying the load bearing elements, the collapsible energy absorbing interfaces of the rotational support hardware 36 and the gaps between the unloading surfaces and corresponding surfaces are such that the load bearing elements (i) operate by bearing the load in normal conditions (i.e., G-forces well under 20,000 to 30,000 G's) but (ii) are shielded from damage during the extreme loading conditions.

As mentioned above, improved nose articulation techniques involve utilization of (i) a stator 32 which attaches to a nose member 24 (e.g., a nose cone of a guidable projectile) and (ii) a rotor 34 which attaches to a projectile body 26 (e.g., a main casing of the guidable projectile). Accordingly, the stator 32 and the rotor 34 form a motor/generator 42 which is capable of (i) controlling rotation of the projectile body 26 relative to the nose member 24 as well as (ii) generating electrical power. Moreover, electrical control of the stator 32 and other electrical or electromechanical components (e.g., a nose cone actuator) are capable of residing at fixed locations 206 relative to the stator 32 (e.g., on the stator shaft 102) thus alleviating any need to convey electrical power and electrical control signals from the projectile body 26 to the stator 32 or to the nose member 24 through slip rings.

It should be understood that the above-described nose articulation techniques are well suited for a variety of applications such as one that involves maneuvering a body using a motor rotational in one direction to move an aerodynamic device in an oscillating motion. A similar application is described in U.S. application Ser. No. 11/651,864, entitled "ECCENTRIC DRIVE CONTROL ACTUATION SYSTEM", the teachings of which are hereby incorporated by reference in their entirety.

While various embodiments of the invention have been particularly shown and described, it will be understood by those skilled in the art that various changes in form and details may be made therein without departing from the spirit and scope of the invention as defined by the appended claims.

For example, the nose member articulation assembly 22 was described above as being well-suited for guided missile applications. It should be understood that the nose member articulation assembly 22 is a mechanism that enables conversion of an existing "dumb" artillery round or a legacy dumb round design into a "smart" round. In particular, one is capable of making a dumb round smart by attaching the nose member articulation assembly 22 to the front of the dumb round. Alternatively, one is capable of making a smart round by interconnecting the nose member articulation assembly 22 between (i) the nose, or fuse, of the dumb round and (ii) the following body which carries the explosive charge or other payload of the dumb round.

Additionally, it should be understood that the axial displacement loading springs were described above as Belleville springs by way of example only. Other loading springs are suitable for use as well such as finger springs, wave spring washers, curved springs, tab washers, notch washers, and the like.

Similarly, it should be understood that the radial displacement loading springs were described above as tolerance rings by way of example only. Other loading springs are suitable for use as well such as washers, leaf springs, circular suspensions, and the like.

What is claimed is:

1. A guidable projectile, comprising:

a nose member;

a projectile body; and a nose member articulation assembly which couples the nose member to the projectile body, the nose member articulation assembly including:

a stator attached to the nose member, a rotor attached to the projectile body, and rotational support hardware operatively associating the stator to the rotor, the stator defining a central axis, the rotational support hardware being constructed and arranged to guide rotation of the rotor around the central axis defined by the stator.

2. A guidable projectile as in claim 1 wherein the stator of the nose member articulation assembly includes (i) a stator shaft which extends along the central axis and (ii) motor windings supported by the stator shaft;

wherein the rotor of the nose member articulation assembly includes (i) a rotor housing and (ii) a set of magnets supported by the rotor housing; and wherein the nose member articulation assembly further includes a control circuit which is constructed and arranged to control current through the motor windings of the stator to control rotation of the rotor around the stator.

3. A guidable projectile as in claim 2 wherein the nose member articulation assembly further includes:

a set of power cells constructed and arranged to provide power to the control circuit; and wherein the stator shaft is constructed and arranged to support the set of power cells at a fixed power cell mounting location on the stator shaft.

4. A guidable projectile as in claim 3 wherein the nose member articulation assembly further includes:

a generator circuit constructed and arranged to obtain a charge from the motor windings when the rotor rotates around the stator shaft and store that charge in the set of power cells; and wherein the stator shaft is constructed and arranged to support the generator circuit at a fixed generator circuit mounting location on the stator shaft.

5. A guidable projectile as in claim 2 wherein the nose member articulation assembly further includes a nose member tilt actuator having a base and a crank arm;

wherein the stator shaft is constructed and arranged to support the base of the nose member tilt actuator at a fixed nose member tilt actuator mounting location on the stator shaft; and wherein the crank arm of the nose member tilt actuator is constructed and arranged to pivotally attach to the nose member to control tilting of the nose member relative to the stator shaft.

6. A guidable projectile as in claim 5 wherein the nose member articulation assembly further includes a two-channel drive circuit having (i) a first channel constructed and arranged to drive a first motor formed by the stator and the rotor, and (ii) a second channel constructed and arranged to drive the nose member tilt actuator; and wherein the stator shaft is constructed and arranged to support the two channel drive circuit at a fixed drive circuit mounting location on the stator shaft.

7. A guidable projectile as in claim 2 wherein the rotational support hardware of the nose member articulation assembly includes (i) a first set of bearings disposed adjacent a first end of the stator shaft, and (ii) a second set of bearings disposed adjacent a second end of the stator shaft, the first and second sets of bearings being constructed and arranged to control rotation of the rotor around the stator;

wherein the stator shaft defines an axial displacement unloading surface; and wherein the axial displacement unloading surface defined by the stator shaft is constructed and arranged to contact a corresponding surface on the rotor housing to prevent overloading of at least one of the first and second sets of bearings when the guidable projectile undergoes acceleration above a predefined threshold in a forward direction along the central axis defined by the stator.

8. A guidable projectile as in claim 7 wherein the rotational support hardware further includes:

a set of axial loading springs constructed and arranged to maintain an axial gap between (i) the axial displacement unloading surface defined by the stator shaft and (ii) the corresponding surface on the rotor housing to keep (i) the axial displacement unloading surface defined by the stator shaft and (ii) the corresponding surface on the rotor housing out of direct contact during times when the guidable projectile undergoes acceleration below the predefined threshold in the forward direction along the central axis defined by the stator.

9. A guidable projectile as in claim 2 wherein the rotational support hardware of the nose member articulation assembly includes (i) a first set of bearings disposed adjacent a first end of the stator shaft, and (ii) a second set of bearings disposed adjacent a second end of the stator shaft, the first and second sets of bearings being constructed and arranged to control rotation of the rotor around the stator;

wherein the stator shaft defines a radial displacement unloading surface; and wherein the radial displacement unloading surface defined by the stator shaft is constructed and arranged to contact a corresponding surface on the rotor housing to prevent overloading of at least one of the first and second sets of bearings when the guidable projectile undergoes acceleration above a predefined threshold in a radial direction relative to the central axis defined by the stator.

10. A guidable projectile as in claim 9 wherein the rotational support hardware further includes:

a first set of tolerance rings adjacent to the first set of bearings, and a second set of tolerance rings adjacent to the second set of bearings, the first and second sets of tolerance rings being constructed and arranged to maintain a radial gap between (i) the radial displacement unloading surface defined by the stator shaft and (ii) the corresponding surface on the rotor housing to keep (i) the radial displacement unloading surface defined by the stator shaft and (ii) the corresponding surface on the rotor housing out of direct contact during times when the guidable projectile undergoes acceleration below the predefined threshold in the radial direction relative to the central axis defined by the stator.

11. A nose member articulation assembly, comprising:

a stator constructed and arranged to attach to a nose member;

a rotor constructed and arranged to attach to a projectile body; and rotational support hardware operatively associating the stator to the rotor, the stator defining a central axis, the rotational support hardware being constructed and arranged to guide rotation of the rotor around the central axis defined by the stator.

12. A nose member articulation assembly as in claim 11 wherein the stator includes (i) a stator shaft which extends along the central axis and (ii) motor windings supported by the stator shaft;

wherein the rotor includes (i) a rotor housing and (ii) a set of magnets supported by the rotor housing; and wherein the nose member articulation assembly further comprises a control circuit which is constructed and arranged to control current through the motor windings of the stator to control rotation of the rotor around the stator.

13. A nose member articulation assembly as in claim 12, further comprising:

a set of power cells constructed and arranged to provide power to the control circuit; and wherein the stator shaft is constructed and arranged to support the set of power cells at a fixed power cell mounting location on the stator shaft.

14. A nose member articulation assembly as in claim 13, further comprising:

a generator circuit constructed and arranged to obtain a charge from the motor windings when the rotor rotates around the stator shaft and store that charge in the set of power cells; and wherein the stator shaft is constructed and arranged to support the generator circuit at a fixed generator circuit mounting location on the stator shaft.

15. A nose member articulation assembly as in claim 12, further comprising a nose member tilt actuator having a base and a crank arm;

wherein the stator shaft is constructed and arranged to support the base of the nose member tilt actuator at a fixed nose member tilt actuator mounting location on the stator shaft; and wherein the crank arm of the nose member tilt actuator is constructed and arranged to pivotally attach to the nose member to control tilting of the nose member relative to the stator shaft.

16. A nose member articulation assembly as in claim 15, further comprising a two-channel drive circuit having (i) a first channel constructed and arranged to drive a first motor formed by the stator and the rotor, and (ii) a second channel constructed and arranged to drive the nose member tilt actuator; and wherein the stator shaft is constructed and arranged to support the two channel drive circuit at a fixed drive circuit mounting location on the stator shaft.

17. A nose member articulation assembly as in claim 12 wherein the rotational support hardware includes (i) a first set of bearings disposed adjacent a first end of the stator shaft, and (ii) a second set of bearings disposed adjacent a second end of the stator shaft, the first and second sets of bearings being constructed and arranged to control rotation of the rotor around the stator;

wherein the stator shaft defines an axial displacement unloading surface; and wherein the axial displacement unloading surface defined by the stator shaft is constructed and arranged to contact a corresponding surface on the rotor housing to prevent overloading of at least one of the first and second sets of bearings when the nose member articulation assembly undergoes acceleration above a predefined threshold in a forward direction along the central axis defined by the stator.

18. A nose member articulation assembly as in claim 17 wherein the rotational support hardware further includes:

a set of axial loading springs constructed and arranged to maintain an axial gap between (i) the axial displacement unloading surface defined by the stator shaft and (ii) the corresponding surface on the rotor housing to keep (i) the axial displacement unloading surface defined by the stator shaft and (ii) the corresponding surface on the rotor housing out of direct contact during times when the nose member articulation assembly undergoes acceleration below the predefined threshold in the forward direction along the central axis defined by the stator.

19. A nose member articulation assembly as in claim 12 wherein the rotational support hardware includes (i) a first set of bearings disposed adjacent a first end of the stator shaft, and (ii) a second set of bearings disposed adjacent a second end of the stator shaft, the first and second sets of bearings being constructed and arranged to control rotation of the rotor around the stator;

wherein the stator shaft defines a radial displacement unloading surface; and wherein the radial displacement unloading surface defined by the stator shaft is constructed and arranged to contact a corresponding surface on the rotor housing to prevent overloading of at least one of the first and second sets of bearings when the nose member articulation assembly undergoes acceleration above a predefined threshold in a radial direction relative to the central axis defined by the stator.

20. A nose member articulation assembly as in claim 19 wherein the rotational support hardware further includes:

a first set of tolerance rings adjacent to the first set of bearings, and a second set of tolerance rings adjacent to the second set of bearings, the first and second sets of tolerance rings being constructed and arranged to maintain a radial gap between (i) the radial displacement unloading surface defined by the stator shaft and (ii) the corresponding surface on the rotor housing to keep (i) the radial displacement unloading surface defined by the stator shaft and (ii) the corresponding surface on the rotor housing out of direct contact during times when the nose member articulation assembly undergoes acceleration below the predefined threshold in the radial direction relative to the central axis defined by the stator.

* * * * *